US005265293A

United States Patent [19]

Spahn et al.

[11] Patent Number: 5,265,293

[45] Date of Patent: Nov. 30, 1993

[54] INFLATABLE BODY SUPPORT

[75] Inventors: James G. Spahn, Indianapolis; Steven P. Langley, Martinsville, both of Ind.

[73] Assignee: Ehob, Inc., Indianapolis, Ind.

[21] Appl. No.: 12,507

[22] Filed: Feb. 2, 1993

[51] Int. Cl.[5] ..... A61C 7/04; A41F 1/00

[52] U.S. Cl. ..... 5/449; 5/458; 5/461; 5/411; 5/903; 24/664; 24/464

[58] Field of Search ..... 5/449, 455, 456, 458, 5/401, 464, 411, 903; 24/664, 464

[56] References Cited

U.S. PATENT DOCUMENTS

| | | | |
|---|---|---|---|
| 1,595,698 | 8/1926 | Wilson . | |
| 2,522,079 | 9/1950 | Winstead | 5/449 X |
| 2,625,209 | 1/1953 | Harrison et al. . | |
| 3,253,861 | 5/1966 | Howard . | |
| 3,530,550 | 9/1970 | White | 24/464 |
| 4,454,615 | 6/1984 | Whitney | 5/903 X |
| 4,483,030 | 11/1984 | Flick et al. | 5/455 X |
| 4,685,163 | 8/1987 | Quillen et al. . | |
| 5,097,552 | 3/1992 | Viesturs | 5/449 |
| 5,103,518 | 4/1992 | Gilroy et al. | 5/449 X |
| 5,113,553 | 5/1992 | Hutchinson | 24/464 |

FOREIGN PATENT DOCUMENTS

| | | |
|---|---|---|
| 1118087 | 5/1956 | France . |
| 1169286 | 12/1958 | France . |

OTHER PUBLICATIONS

Gaymar ® Advertising Brochure, ©1990, Gaymar Industries, Inc., of Orchard Park, N.Y.

The Original WAFFLE ® Products Advertising Brochure by EHOB ®, ©EHOB ®, Inc. 1990, of Indianapolis, Ind.

*Primary Examiner*—Michael F. Trettel

*Attorney, Agent, or Firm*—Woodard, Emhardt, Naughton, Moriarty & McNett

[57] ABSTRACT

In combination with an inflatable body support formed from a pair of plastic sheets joined together forming an air pressurizable chamber therebetween, the sheets having a plurality of aligned holes extending therethrough with the sheets being joined together around the circumference of each hole allowing body heat and moisture to flow through each hole but preventing air flow from the chamber into each hole, thereby providing an air cushion for supporting a person positioned thereatop that dissipates pressure, heat and moisture to prevent the onset of pressure sores and ulcers, the improvement which comprises: occluding the holes over which the torso, head and limbs of a person positioned atop the inflatable body support would not lie, thereby reducing the distension of the inflatable body support surrounding the occluded holes thereby volume centering the air within the air pressurizable chamber under a person positioned atop the inflatable body support; providing a pair of micro and macro adjustable, separable, and generally U-shaped anchoring straps, each strap having two generally boomerang-shaped halves disposed in mirror image relationship; and a novel connector that may be opened by two fingers that removably attaches the anchoring straps to the inflatable body support.

22 Claims, 4 Drawing Sheets

INFLATABLE BODY SUPPORT

BACKGROUND OF THE INVENTION

The present invention generally relates to the field of reclining devices for supporting the human body, and more particularly to an improved inflatable body support that provides pressure, heat and moisture dissipation to prevent the onset of pressure sores and ulcers.

Pressure sores, and resulting ulcers, can begin long before a person is lying on a hospital bed. Pressure sores can result from the person being placed upon a hard hospital transportation cart, operating room table, CAT scanner, cardiac or day chair or wheelchair for an extended length of time. Inflatable pressure reducing and heat dissipating body supports, such as the one disclosed and illustrated in FIG. 6 of U.S. Pat. No. 4,685,163 to Quillen et al., are now we known in the prior art as simple, cost effective means to provide effective skin care management. The inflatable body support in FIG. 6 of Quillen et al. is formed from a pair of plastic sheets joined together about their common periphery to form a single air pressurizable chamber therebetween. The pair of plastic sheets also have a plurality of aligned holes extending therethrough with the sheets being joined together around the circumference of each hole, preventing air flow from the air pressurizable chamber into the holes. The end result is a single chambered inflatable body cushion with a plurality of holes through and through.

The single air chamber design of the prior art inflatable body supports, such as the support of FIG. 6 of Quillen et al., are designed to provide equal support to the entire body, thereby reducing pressure on any one area to well below the capillary closure pressure to prevent pressure sores and ulcers from developing. Since heat build up can lead to tissue breakdown and harbor infection, air circulation is promoted by providing holes through and through the single air chamber over substantially its entire surface area. These holes also permit moisture to flow down and away from the person, which is particularly important for the incontinent person. Prior art inflatable body supports without holes through and through therefore do not provide adequate heat and moisture dissipation.

Skin friction and deep tissue shear is minimized in state of the prior art inflatable body supports through the use of non-abrasive materials of construction, which allows the person to easily move, eliminating friction or resistance. A non-porous, durable, hypo-allergenic vinyl with a flame retardant and an anti-microbial added has been a preferred material to date. The single air chamber, low profile design also deceases deep tissue shear because the support will contour to the person's body, thus cradling the body to provide support. For person safety, adjustable VELCRO brand hook and loop fasteners have been utilized to anchor the prior art supports to a mattress or other support surface.

Exemplary state of the prior art inflatable body supports of the Quillen et al. type described above are manufactured by EHOB, Inc., of Indianapolis, Ind., and are identified by the WAFFLE trademark, which is Registered in the U.S. Patent and Trademark Office.

SUMMARY OF THE INVENTION

The inflatable body support of the present invention includes novel improvements in combination with the state of the prior art inflatable body supports having holes through and through of the Quillen et al. type, described within the Background of the Invention section, above.

The improvements of the present invention include means for volume centering of the air within the inflatable body support of the Quillen et al. type under the torso, head and limbs, thereby maximizing the volume of air within the inflatable body support that is cushioning the torso, head and limbs. The volume centering improvements of the present invention allow an inflatable body support of the Quillen et al. type to be inflated to a desirably lower initial air pressure and still prevent the air cushion from collapsing under the weight of the torso, head and limbs. This end is accomplished in the preferred embodiment of the present invention by controlling the distension of the prior art inflatable body supports of the Quillen et al. type in those areas of the support that are not directly under the torso, head and limbs. As the through holes and surrounding materials of construction of the prior art inflatable body supports of the Quillen et al. type stretch, the volume of the air chamber in those areas increases, which permits a greater volume of air to flow to such areas from under the torso, head and limbs. Controlling the distension of the inflatable body support in those areas of the support that are not to be under the torso, head and limbs controls the increases in air chamber volume in such areas when a person lies atop the support. If the volume of the air chamber in such areas does not appreciably increase when a person lies atop the support, the air in the air chamber under the torso, head and limbs will not as readily flow to such other areas. There will be a smaller increase in the volume of the air chamber in such other areas to accommodate the additional air flow. In essence, the volume of air under the torso, head and limbs will remain centered there by controlling the distension of the inflatable body support in the areas that are not under the torso, head and limbs.

By allowing the through holes and the surrounding materials of construction to stretch under the torso, head and limbs while controlling the distension of the inflatable body support in all other areas there is also a maximization of the surface contact with the torso, head and limbs, resulting in a maximization of the supportive surface. Also, undesirable shear stresses between the inflatable body support and the person are supplanted by more desirable perpendicular stresses as the through holes and surrounding materials of construction stretch to conform to the contours of the torso, head and limbs.

The improvements of the present invention also include novel micro and macro adjustable anchoring straps that are separable and removably attachable to the inflatable body support of the present invention for securing the body support to mattresses, and the like, of varying dimensions. The straps of the present invention have a novel boomerang-like shape that enhance their gripping abilities, and they are constructed from the same type of materials of construction as is the inflatable body support.

One embodiment of the present invention is, in combination with an inflatable body support formed from a pair of plastic sheets joined together forming an air pressurizable chamber therebetween, the sheets having a plurality of aligned holes extending therethrough with the sheets being joined together around the circumference of each hole allowing body heat and moisture to flow through each hole but preventing air flow from the chamber into each hole, thereby providing an air cushion for supporting a person positioned thereatop that dissipates pressure, heat and moisture to prevent the onset of pressure sores and ulcers, the improvement which comprises: occlusion means joined with the sheets about the circumference of a plurality of the holes over which the torso, head and limbs of a person positioned atop the inflatable body support would not lie, occluding such holes and reducing the distension of the inflatable body support surrounding the occluded holes thereby volume centering the air within the air pressurizable chamber under a person positioned atop the inflatable body support.

Another embodiment of the present invention is, in combination with an inflatable body support formed from a pair of plastic sheets joined together forming an air pressurizable chamber therebetween, the sheets having a plurality of aligned holes extending therethrough with the sheets being joined together around the circumference of each hole allowing body heat and moisture to flow through each hole but preventing air flow from the chamber into each hole, thereby providing an air cushion for supporting a person positioned thereatop that dissipates pressure, heat and moisture to prevent the onset of pressure sores and ulcers, the improvement which comprises: a plurality of strap tabs attached to the perimeter of the inflatable body support, each tab having at least one tab hole and a number of the tabs having a plurality of spaced apart tab holes; a pair of separable, generally U-shaped anchoring straps, each strap having two generally boomerang-shaped halves disposed in mirror image relationship and at least one strap hole at each free end thereof; and connector means to removably attach the anchoring straps to the strap tabs when selected strap holes in the anchoring straps are aligned with selected tab holes in the strap tabs.

Another embodiment of the present invention is, in combination with an inflatable body support formed from a pair of plastic sheets joined together forming an air pressurizable chamber therebetween, the sheets having a plurality of aligned holes extending therethrough with the sheets being joined together around the circumference of each hole allowing body heat and moisture to flow through each hole but preventing air flow from the chamber into each hole, thereby providing an air cushion for supporting a person positioned thereatop that dissipates pressure, heat and moisture to prevent the onset of pressure sores and ulcers, the improvement which comprises: occlusion means joined with the sheets about the circumference of a plurality of the holes over which the torso, head and limbs of a person positioned atop the inflatable body support would not lie, occluding such holes and reducing the distension of the inflatable body support surrounding the occluded holes thereby volume centering the air within the air pressurizable chamber under a person positioned atop the inflatable body support; a plurality of strap tabs attached to the perimeter of the inflatable body support, each tab having at least one tab hole and a number of the tabs having a plurality of spaced apart tab holes; a pair of separable, generally U-shaped anchoring straps, each strap having two generally boomerang-shaped halves disposed in mirror image relationship and at least one strap hole at each free end thereof; and connector means to removably attach the anchoring straps to the strap tabs when selected strap holes in the anchoring straps are aligned with selected tab holes in the strap tabs.

Another embodiment of the present invention is a connector, comprising: a button supported upon a base member; a closure member connected to the base member and having a pair of pinch tabs; and a through hole disposed between the pinch tabs, the through hole being sized to snappingly receive the button in locking relationship when the pinch tabs are in substantially planar relationship with the through hole, and elliptically distorting when the pinch tabs are pinched between a thumb and first finger into a non-planar relationship with the through hole means thereby freeing the closure member from its locking engagement with the button.

It is an object of the present invention to provide an improved inflatable body support of the Quillen et al. type that volume centers air within the body support under a person's torso, head and limbs to permit the body support to be inflated to lower and more desirable internal air pressures.

It is an object of the present invention to provide an improved inflatable body support that has micro and macro adjustable anchoring straps with improved gripping characteristics.

It is a further object of the present invention to provide a novel connector with a two-finger pinch-to-open releasing action.

Related objects and advantages of the present invention will be apparent from the following descriptions.

DESCRIPTION OF THE PREFERRED EMBODIMENTS

Figure 1:
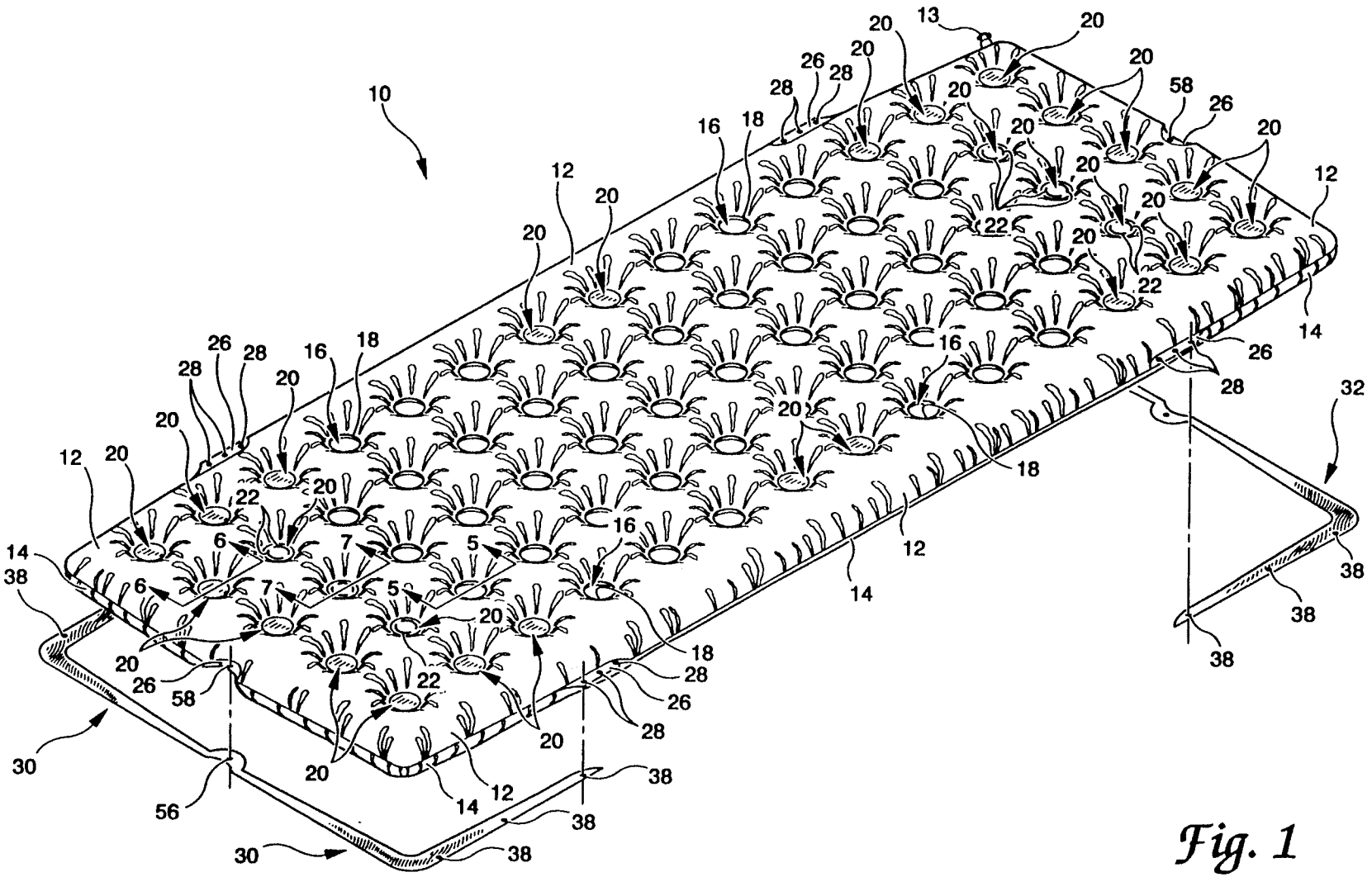
FIG. 1 is a partially exploded, perspective view of a preferred embodiment of the inflatable body support of the present invention.

For the purposes of promoting an understanding of the principles of the invention, reference will now be made to the embodiments illustrated in the drawings and specific language will be used to describe the same.

It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

Figure 5:
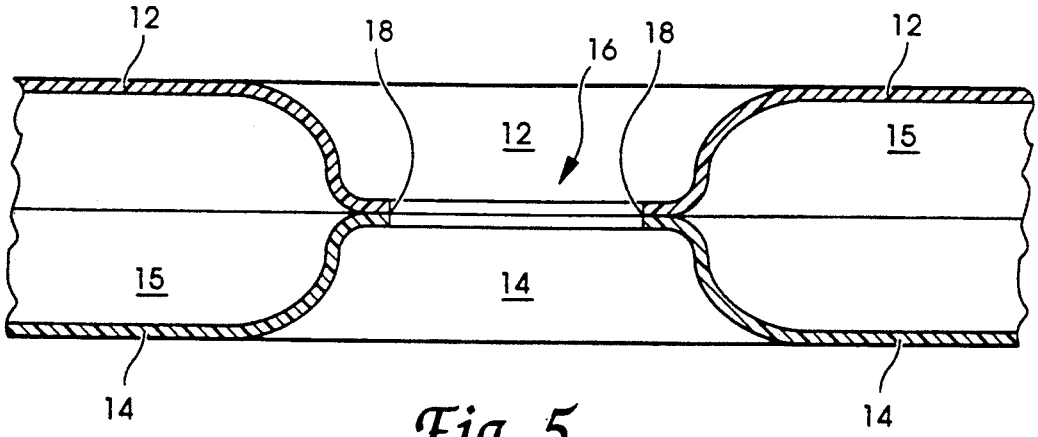
FIG. 5 is an enlarged cross-sectional view of the inflatable body support of FIG. 1 taken along line 5—5 in the direction of rows.
Figure 6:
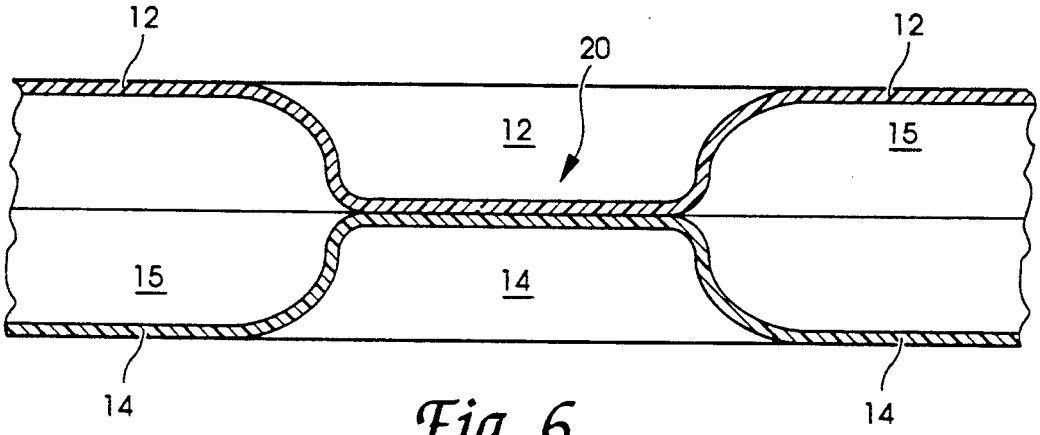
FIG. 6 an enlarged cross-sectional view of the inflatable body support of FIG. 1 taken along line 6—6 in the direction of the arrows.

Referring now to the drawings, FIG. 1 illustrates the preferred embodiments of the improvements of the present invention in combination with a state of the prior art inflatable body support of the Quillen et al. type. The improved inflatable body support 10 of the present invention includes a pair of plastic sheets 12 and 14 that are joined together by conventional means to form an air pressurizable chamber 15 therebetween (see FIGS. 5–7) that can be pressurized via a conventional air valve 13. The sheets 12 and 14 have a plurality of aligned through holes 16 extending therethrough, allowing body heat and moisture to flow through the sheets, with the sheets 12 and 14 being joined together around the circumference 18 of each hole 16 (see FIG. 5) by conventional bar welding techniques to prevent air flow into the holes 16 from the pressurizable air chamber 15 formed by the sheets 12 and 14.

In the state of the prior art inflatable body supports of the Quillen et al. type, aligned through holes 16 are provided over substantially the entire surface area of the joined sheets that form the air pressurizable chamber 15, for the principal reason that joining the sheets together around the circumference 18 of each hole 16 helps to maintain the integrity of the joined sheets as an air pressurizable chamber 15 that will support a person thereatop. In a preferred prior art construction technique, the through holes 16 are formed by first joining the pair of sheets 12 and 14 together by conventional bar welding techniques about what will become the circumference 18 of each through hole 16. Through holes 16 are then formed by cutting away the pair of plastic sheets 12 and 14 that lie within the circumferential joinder 18 of the sheets surrounding the through holes 16.

In the preferred embodiment of the body support 10 of the present invention, through holes 16 are constructed in this fashion (see FIG. 5), but only in those areas of body support 10 that will lie under the torso, head and limbs of a person lying thereatop. In the remaining areas of body support 10 where the sheets 12 and 14 have been circumferentially joined as in the prior art construction technique, the pair of plastic sheets 20 that lie within the circumferential joinders 18 of the sheets 12 and 14 are not cut away, but are left in place (see FIG. 6) to leave occluded what would otherwise have become through holes 16 by the prior art construction technique.

Testing of the preferred embodiment of the inflatable body support 10 of the present invention to date has established that when a person lies atop body support 10, the circumferential joinders 18 and the sheets 12 and 14 surrounding the pair of plastic sheets 20 left in places that would otherwise have become through holes 16 do not stretch as much as do the circumferential joinders 18 and the sheets 12 and 14 that surround through holes 16. Consequently, inflatable body support 10 does not distend as much in the areas surrounding the pair of plastic sheets 20 as it does in the areas where through holes 16 have been formed. If the volume of air chamber 15 in those areas of the inflatable body support 10 that are not to be under the torso, head and limbs does not appreciably increase by distension when a person lies thereatop, the volume of air in air chamber 15 under the torso, head and limbs will not be readily displaced from under the torso, head and limbs. There will not be a sufficient increase in volume in other areas of air chamber 15 to accommodate a significant additional volume of air from under the torso, head and limbs. In essence, controlling the distension of the inflatable body support 10 in areas that are not to be under the torso, head and limbs volume centers the air within air chamber 15 in areas that will be under the torso, head and limbs.

Extensive CT scanning and magnetic resonance imaging in testing completed to date has confirmed that the preferred embodiment of the present invention does volume center the air within air chamber 15 under the torso, head and limbs of a person lying atop inflatable body support 10, in the manner described, thereby maximizing the volume of air within air chamber 15 that is cushioning the torso, head and limbs.

Figure 7:
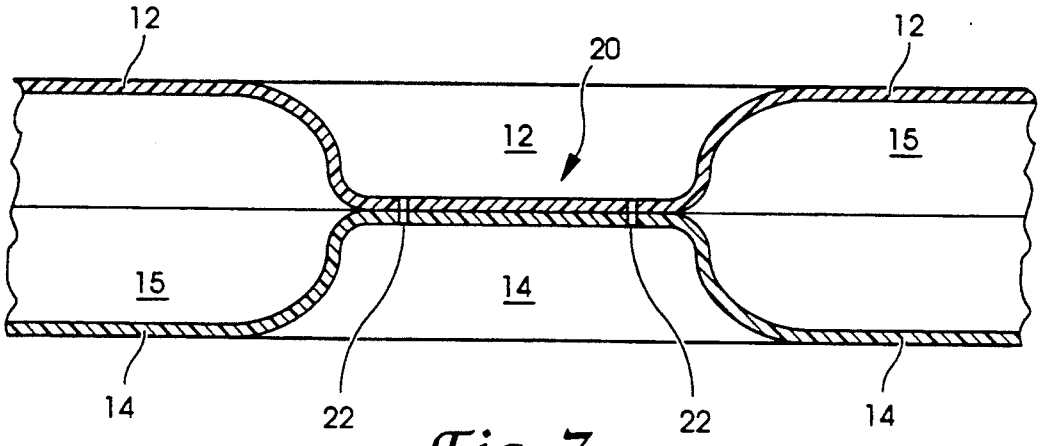
FIG. 7 is an enlarged cross-sectional view of the inflatable body support of FIG. 1 taken along line 6—6 in the direction of the arrows.
Figure 8:
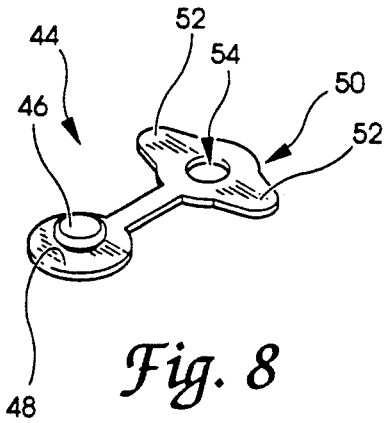
FIG. 8 is a perspective view of the preferred connector means of the present invention.
Figure 9:
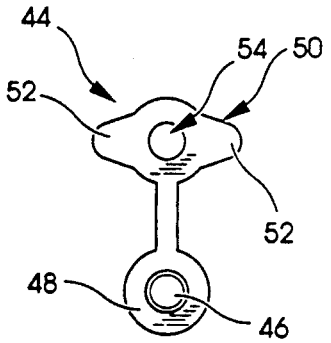
FIG. 9 is top plan view of the connector means of FIG. 7.
Figure 11:
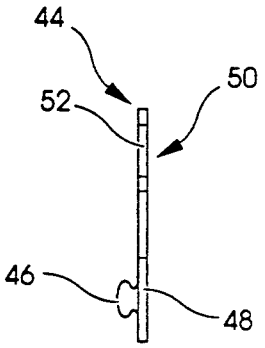
FIG. 11 is a bottom plan view of the connector means of FIG. 8.
Figure 10:
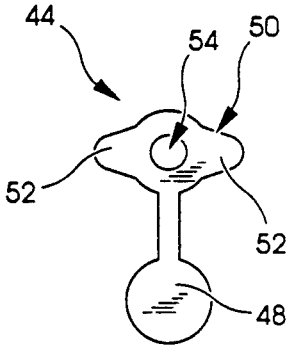
FIG. 10 is a right side elevation view of the connector means of FIG. 8.

Referring now to FIGS. 1 and 7, a plurality of the pair of plastic sheets 20 left occluding what would otherwise have become through holes 16 have been further provided with at least one through slit 22, the presence of which permits some additional stretching of the pair of plastic sheets 20 and some corresponding additional distension of the surrounding inflatable body support 10. Selective placement of slits 22 in pairs of plastic sheets 20 allows for limited control over the degree of distension of those portions of inflatable body support 10 that may only partially cushion the head and limb areas, where some moderate distension of inflatable body support 10 may be desirable for adequate cushioning.

Figure 2:
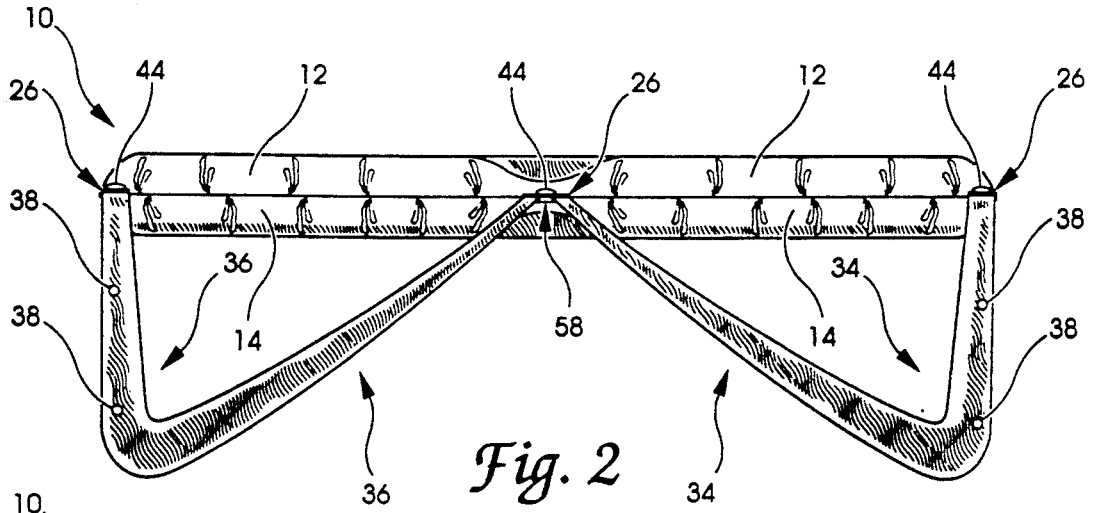
FIG. 2 is a left end view of the inflatable body support of FIG. 1.
Figure 3:
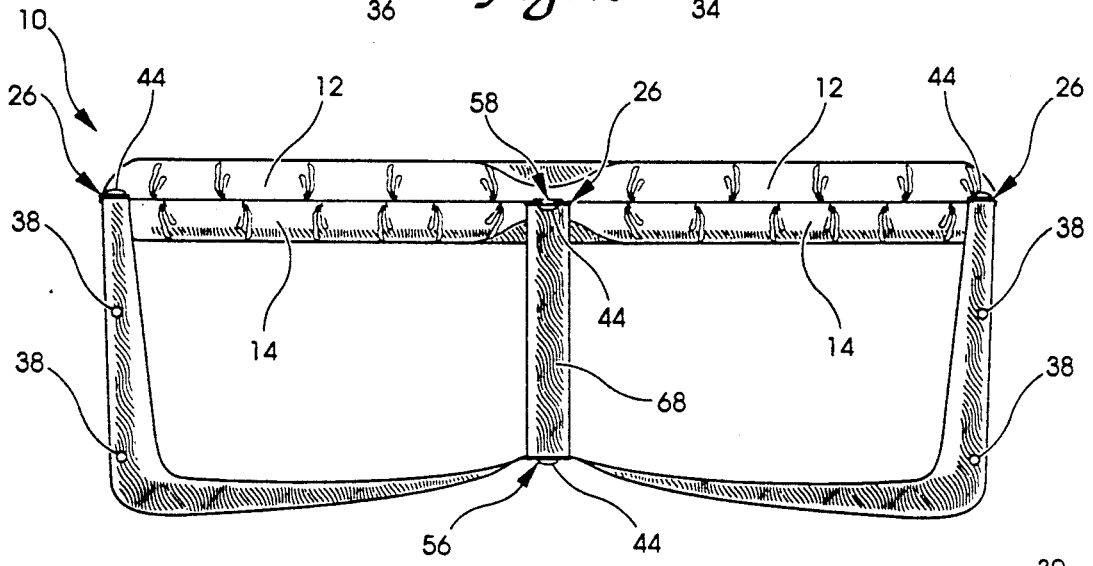
FIG. 3 is a left end view of the inflatable body support of FIG. 1, with an alternative strap embodiment of the present invention.
Figure 4:
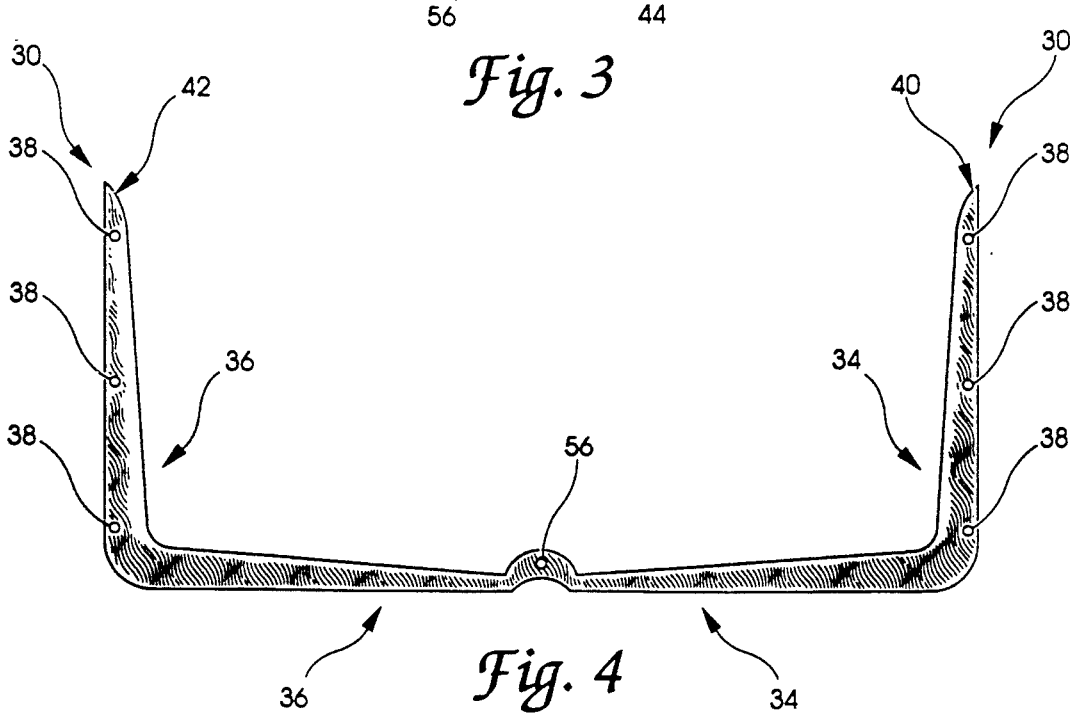
FIG. 4 is a top plan view of the preferred strap of the present invention.

Referring now to FIGS. 1–4, the improved inflatable body support 10 of the present invention further includes novel macro and micro adjustable anchoring straps 30 and 32 that are separable and removably attachable to the inflated body support 10 of the preferred embodiment for securing the inflatable body support 10 to mattresses, and the like, of varying dimensions. To accommodate the anchoring straps 30 and 32, a plurality of strap tabs 26 are attached to the perimeter of the inflatable body support 10, with each tab having at least one tab hole 28, and a number of the tabs 26 having a plurality of spaced apart tab holes 28. The anchoring straps 30 and 32 of the preferred embodiment are each generally U-shaped and are substantially identical in shape and construction. In the preferred embodiment, anchoring straps 30 and 32 are constructed from the same materials of construction as are sheets 12 and 14 of the inflatable body support 10. A plan view of anchoring strap 30 is illustrated in FIG. 4.

Referring to FIG. 4, and anchoring strap 30, each anchoring strap has two generally boomerang-shaped halves 34 and 36, the shapes of which were found to improve the gripping characteristics of the anchoring straps, that are disposed in mirror image relationship, with a plurality of strap holes 38 provided at each free end 40 and 42 thereof. In the preferred embodiment illustrated in FIGS. 1–4, the plurality of strap holes 38 at the free ends 40 and 42 of anchoring strap 30 are spaced farther apart from each other than are the spaced apart tab holes 28 on the strap tabs 26 that have a plurality of tab holes 28, which allow macro and micro adjustments of the connections between the strap tabs 26 and the anchoring straps 24, as will be evident from the discussion below.

Figure 12:
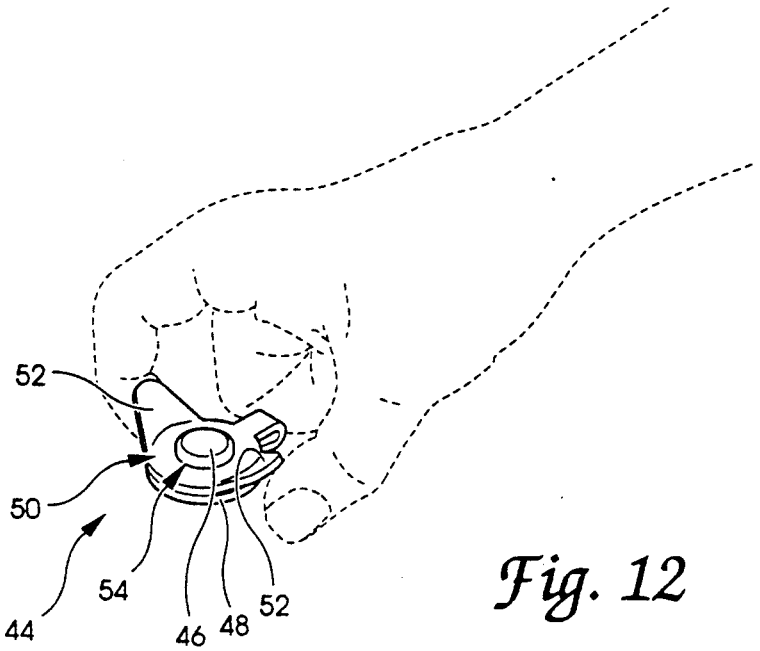
FIG. 12 is a perspective view of the connector means of FIG. 8 in the pinch-to-open configuration, with an operator's hand shown in dotted outline.

Referring now to FIGS. 8–11, a novel connector 44 is provided to removably attach the anchoring straps 30 and 32 to the strap tabs 26 when selected strap holes 38 in anchoring straps 30 and 32 are aligned with selected tab holes 28 in the strap tabs 26. In the preferred embodiment, connector 44 has a button 46 that is sized to be snugly received through strap holes 38 in anchoring straps 30 and 32, and through tab holes 28 in strap tabs 26. Button 46 is supported upon a base member 48, which is connected to a closure member 50 having a pair of pinch tabs 52 and a through hole 54 therebetween. Through hole 54 is sized to snugly receive button 46. Connector 44 is constructed from a relatively pliable plastic material such that the through hole 54 may be sized to cause closure member 50 to snap onto button 46 when pinch tabs 53 are substantially planar with through hole 54, and such that through hole 54 elliptically distorts when pinch tabs 52 are pinched between a thumb and first finger, for example (see FIG. 12), thereby allowing closure member 50 to be freed from its engagement with button 46. Connector 44 is the preferred connector for all removable connections of straps 30 and 32 and tabs 26 of the preferred embodiment, for it resists unsnapping under shear stresses, yet is easily released by pinching tabs 52 with two fingers of one hand.

Referring again to FIGS. 1–4, and anchoring strap 30, corresponding strap holes 38 at the free ends 40 and 42 of anchoring strap 30 are aligned with corresponding tab holes 28 of two of the strap tabs 26 that have a plurality of spaced apart tab holes 28 (see FIG. 1). Micro adjustments of the overall length of anchoring strap 30 may be made by aligning the corresponding strap holes 38 at the free ends 40 and 42 of anchoring strap 30 with another pair of tab holes 28 selected from among the plurality of the spaced apart tab holes 28 on the strap tabs 26 that have been provided with a plurality of spaced apart tab holes 28. Macro adjustments of the overall length of anchoring strap 30 may be made by aligning yet another pair of corresponding strap holes 38 at the free ends 40 and 42 of anchoring strap 30 with tab holes 28 selected from among the plurality of the spaced apart tab holes 28 on the strap tabs 26 that have been provided with a plurality of spaced apart tab holes 28.

Continuing to refer to FIGS. 1–4, and anchoring strap 30, at least one strap hole 56 is provided in each of the anchoring straps 30 and 32 between the two generally boomerang-shaped halves 34 and 36 thereof. Referring now to FIG. 2, in one preferred embodiment, strap hole 56 is aligned with and removably attached with the connector 44 to a tab hole 58 (FIG. 1) that is disposed between the strap tabs 26 to which the free ends of the anchoring straps 30 and 32 have been attached. In this configuration (FIG. 2) the two generally boomerang-shaped halves 34 and 36 of the anchoring strap 30 would be fit around the corners of a mattress, or the like. Referring now to FIG. 3, and anchoring strap 30, alternatively, an extender anchoring strap 68 having a strap hole 38 at each end thereof may have one of its strap holes 38 aligned with and removably attached with a connector 44 to strap hole 56 of anchoring strap 30, and may have its other strap hole aligned with and removably attached with a connector 44 to tab hole 58. In this configuration (FIG. 3) the two generally boomerang shaped halves of the anchoring strap would be fit around the corners of a deeper mattress, or the like. In a third embodiment, not shown, strap hole 56 of anchoring straps 30 and 32 may be left unattached, and the anchoring straps 30 and 32 could be placed under a mattress, or the like, to anchor the inflatable body support 10 in place.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected. Materials of construction and techniques of construction of the preferred embodiment, as well as the general design of the preferred embodiment, other than the improvements that are the present invention, are the same as those of the Quillen et al. type inflatable body supports described in the Background of the Invention.

What is claimed is:

1. In combination with an inflatable body support formed from a pair of plastic sheets joined together forming an air pressurizable chamber therebetween, the sheets having a plurality of aligned holes extending therethrough with the sheets being joined together around the circumference of each hole allowing body heat and moisture to flow through each hole but preventing air flow from the chamber into each hole, thereby providing an air cushion for supporting a person positioned thereatop that dissipates pressure, heat and moisture to prevent the onset of pressure sores and ulcers, the improvement which comprises:

occlusion means joined with said sheets about the circumference of a plurality of said holes over which the torso, head and limbs of a person positioned atop the inflatable body support would not lie, occluding such holes and reducing any distension of the inflatable body support surrounding the occluded holes thereby volume centering the air within the air pressurizable chamber under a person positioned atop the inflatable body support.

2. The combination of claim 1 wherein said occlusion means include at least one plastic sheet joined with the pair of plastic sheets that were joined together around the circumference of each occluded hole.

3. The combination of claim 2 wherein said occlusion means include the pair of plastic sheets that were joined together around the circumference of each occluded hole.

4. The combination of claim 2 wherein said occulsion means further include at least one slit therethrough in a plurality of the occluded holes that border non-occluded holes.

5. The combination of claim 4 wherein said occulsion means include a pair of crescent-shaped slits in mirror-image relationship cut therethrough.

6. In combination with an inflatable body support formed from a pair of plastic sheets joined together forming an air pressurizable chamber therebetween, the sheets having a plurality of aligned holes extending therethrough with the sheets being joined together around the circumference of each hole allowing body heat and moisture to flow through each hole but preventing air flow from the chamber into each hole, thereby providing an air cushion for supporting a person positioned thereatop that dissipates pressure, heat and moisture to prevent the onset of pressure sores and ulcers, the improvement which comprises:

a plurality of strap tabs attached to the perimeter of said inflatable body support, each tab having at least one tab hole and a number of said tabs having a plurality of spaced apart tab holes;

a pair of separable, generally U-shaped anchoring straps, each strap having two generally boomerang shaped halves disposed in mirror image relationship and at least one strap hole at each free end thereof; and connector means to removably attach said anchoring straps to said strap tabs when selected strap holes in said anchoring straps are aligned with selected tab holes in said strap tabs

7. The combination of claim 6 wherein said anchoring straps have a plurality of spaced apart strap holes at the free ends thereof.

8. The combination of claim 6 wherein the plurality of strap holes at the free ends of said anchoring straps are spaced farther apart from each other than are the spaced apart tab holes on said strap tabs having a plurality of tab holes.

9. The combination of claim 6 and further comprising at least one strap hole in each of said generally U-shaped anchoring straps between the two generally boomerang-shaped halves thereof that is aligned with and removably attach with said connector means to a tab hole in a strap tab that is between the strap tabs to which the free ends of said anchoring straps have been attached.

10. The combination of claim 9 and further comprising a pair of separable, extender anchoring straps, each having a strap hole at each end thereof, one of which is aligned with and removably attached with said connector means to a strap hole in one of said generally U-shaped anchoring straps between the two generally boomerang-shaped halves thereof, and the other of which is aligned with and removably attached with said connector means to a tab hole in a strap tab that is between the strap tabs to which the free ends of said anchoring straps have been attached.

11. The combination of claim 9 wherein said connector means includes a button supported upon a base member;

a closure member connected to the base member and having a pair of pinch tabs; and a through hole means disposed between said pinch tabs, said through hole means being sized to snappingly receive said button in locking relationship when said pinch tabs are in substantially planar relationship with said through hole means, and elliptically distorting when said pinch tabs are pinched between a thumb and first finger into a non-planar relationship with said through hole means thereby freeing said closure member from its locking engagement with the button.

12. In combination with an inflatable body support formed from a pair of plastic sheets joined together forming an air pressurizable chamber therebetween, the sheets having a plurality of aligned holes extending therethrough with the sheets being joined together around the circumference of each hole allowing body heat and moisture to flow through each hole but preventing air flow from the chamber into each hole, thereby providing an air cushion for supporting a person positioned thereatop that dissipates pressure, heat and moisture to prevent the onset of pressure sores and ulcers, the improvement which comprises:

occulsion means joined with said sheets about the circumference of a plurality of said holes over which the torso, head and limbs of a person positioned atop the inflatable body support would not lie, occluding such holes and reducing any distension of the inflatable body support surrounding the occluded holes thereby volume centering the air within the air pressurizable chamber under a person positioned atop the inflatable body support;

a plurality of strap tabs attached to the perimeter of said inflatable body support, each tab having at least one tab hole and a number of said tabs having a plurality of spaced apart tab holes;

a pair of separable, generally U-shaped anchoring straps, each strap having two generally boomerang-shaped halves disposed in mirror image relationship and at least one strap hole at each free end thereof; and connector means to removably attach said anchoring straps to said strap tabs when selected strap holes in said anchoring straps are aligned with selected tab holes in said strap tabs.

13. The combination of claim 12 wherein said occlusion means include at least one plastic sheet joined with the pair of plastic sheets that were joined together around the circumference of each occluded hole.

14. The combination of claim 13 wherein said occlusion means include the pair of plastic sheets that were joined together around the circumference of each occluded hole.

15. The combination of claim 13 wherein said occlusion means further include at least one slit therethrough in a plurality of the occluded holes that border non-occluded holes.

16. The combination of claim 15 wherein said occlusion means include a pair of crescent-shaped slits in mirror-image relationship cut therethrough.

17. The combination of claim 12 wherein said anchoring straps have a plurality of spaced apart strap holes at the free ends thereof.

18. The combination of claim 12 wherein the plurality of strap holes at the free ends of said anchoring straps are spaced farther apart from each other than are the spaced apart tab holes on said strap tabs having a plurality of tab holes.

19. The combination of claim 12 and further comprising at least one strap hole in each of said generally U-shaped anchoring straps between the two generally boomerang-shaped halves thereof that is aligned with and removably attach with said connector means to a tab hole in a strap tab that is between the strap tabs to which the free ends of said anchoring straps have been attached.

20. The combination of claim 19 and further comprising a pair of separable, extender anchoring straps, each having a strap hole at each end thereof, one of which is aligned with and removably attached with said connector means to a strap hole in one of said generally U-shaped anchoring straps between the two generally boomerang-shaped halves thereof, and the other of which is aligned with and removably attached with said connector means to a tab hole in a strap tab that is between the strap tabs to which the free ends of said anchoring straps have been attached.

21. The combination of claim 12 wherein said connector means includes a button supported upon a base member;

a closure member connected to the base member and having a pair of pinch tabs; and a through hole means disposed between said pinch tabs, said through hole means being sized to snappingly receive said button in locking relationship when said pinch tabs are in substantially planar relationship with said through hole means, and elliptically distorting when said pinch tabs are pinched between a thumb and first finger into a non planar relationship with said through hole means thereby freeing said closure member from its locking engagement with the button.

22. A connector, comprising:

a button supported upon a base member;

a closure member connected to the base member and having a pair of pinch tabs; and a through hole means disposed between said pinch tabs, said through hole means being sized to snappingly receive said button in locking relationship when said pinch tabs are in substantially planar relationship with said through hole means, and elliptically distorting when said pinch tabs are pinched between a thumb and first finger into a non-planar relationship with said through hole means thereby freeing said closure member from its locking engagement with the button.

* * * * *

UNITED STATES PATENT AND TRADEMARK OFFICE

CERTIFICATE OF CORRECTION

PATENT NO. : 5,265,293
DATED : November 30, 1993
INVENTOR(S) : James G. Spahn, et. al.

It is certified that error appears in the above-indentified patent and that said Letters Patent is hereby corrected as shown below:

Title page, item [73], Assignee: should read-- EHOB, Inc.--.

Column 1, line 18, change "we" to -- well--.

Column 9, line 6, change "boomerang" to -- boomerang- --.

Column 9, line 13, change "tabs" to -- tabs.--

Column 11, line 9, change "non" to -- - --.

Signed and Sealed this

Twenty-sixth Day of April, 1994

Bruce Lehman

*Attest:*

BRUCE LEHMAN

*Attesting Officer*

*Commissioner of Patents and Trademarks*